United States Patent [19]

DeFrange

[11] Patent Number: 4,607,438

[45] Date of Patent: Aug. 26, 1986

[54] WALL AND RAFTER LAYOUT TOOL

[76] Inventor: Eugene R. DeFrange, 995 W. Jackson, Box B, Krebs, Okla. 74554

[21] Appl. No.: 705,945

[22] Filed: Feb. 26, 1985

[51] Int. Cl.[4] ..... G01C 9/00

[52] U.S. Cl. ..... 33/451; 33/499; 33/562

[58] Field of Search ..... 33/562, 563, 451, 499, 33/459, 452, 458, 460, 462, 465, 470, 468, 498, 495, 496, 418; 403/92, 98, 91

[56] References Cited

U.S. PATENT DOCUMENTS

| | | | |
|---|---|---|---|
| 512,199 | 1/1894 | Love | 33/499 |
| 596,818 | 1/1898 | Moore | 33/499 |
| 733,570 | 7/1903 | Victor | 33/451 |
| 1,142,418 | 6/1915 | Hamalainen | 33/451 |
| 3,169,320 | 2/1965 | Currie . | |
| 4,212,108 | 7/1980 | Jackson | 33/459 |

*Primary Examiner*—William D. Martin, Jr.
*Attorney, Agent, or Firm*—Robert K. Rhea

[57] ABSTRACT

In a wall stud framing tool, an elongated rail is provided with parallel spaced-apart walls joined by a measuring indicia scored angular surface. A plurality of stud position locating tongues are pivotally connected by one end portion between the rail walls. An integral spring member, on the innerconnected end portion of each stud locating tongue, maintains the tongues in right angular relation with respect to the rail when the tongues are in an erected position and maintain the tongues in collapsed or folded position between the rail walls when in a second position.

5 Claims, 7 Drawing Figures

WALL AND RAFTER LAYOUT TOOL

BACKGROUND OF THE INVENTION

1. Field of the Invention

The present invention relates to carpenter's tools and more particularly to a wall stud locating tool.

In the construction of walls for residential dwellings dimensioned lumber, such as 2×4s of selected length, form studs positioned vertically parallel with respect to each other and in selected spaced relationship. The studs extend between a sole plate secured to a floor or wall foundation and a top plate. Normal spacing for the wall studs is 16 inches. It is normal practice to simply use a carpenter's rule and make pencil marks along the sole and top plate at the 16 inch intervals which serves to locate the position of the studs. Although a simple operation, errors can easily result even if only a single mark is made at each stud location. The error may occur by an inaccurate measurement in mentally adding multiples of the 16 inch spacing. Also, if the studs are positioned with one side edge aligned with the pencil mark for a part of the run of the sole plate and the opposite side edge of the remaining stud positioned adjacent the pencil mark for the remaining portion of the sole plate run the spacings between the studs are thus increased or decreased resulting in a mismatch when closing the framed wall, as by using dimensioned panel material. Such errors are costly, particularly if, for example, the outer sheathing has been applied to the frame wall.

This invention renders it simple and accurate to locate stud framing positions.

2. Description of the Prior Art

Wall framing or stud locating tools are not new, as evidenced by U.S. Pat. No. 3,169,320 which discloses an elongated angle member having laterally projecting legs spaced-apart at preselected intervals for marking one or both sides of the position of framing studs on a sole plate, or the like. Tools of this class are generally cumbersome and are not easily stored or manually carried due to their rigid construction.

The tool of this invention is distinctive over this patent and other carpenter's framing tools by connecting a plurality of stud locating members to an elongated base member in a pivotal manner permitting the stud locating members to be folded into the confines of the base member in a jackknife folding blade type of action wherein when folded each pivoting member positively remains in the folded position and when unfolded snaps into its erected position by a self contained spring member.

SUMMARY OF THE INVENTION

An elongated rail, having a bight portion forming a flat base surface, is provided with upstanding parallel walls normal to its base surface with one wall defining an outwardly and downwardly inclined surface opposite the other wall. A plurality of elongated strap-like tongues are pivotally connected at one end between the rail walls for movement in a predetermined direction toward the base surface when not in use. Each of the tongues are provided with a slot in its pivotally connected end portion forming a spring portion and a spring action when the other end of the tongue is pivoted toward or away from the parallel walls by frictional edge contact between the spring portion and adjacent surface of the bight portion. A spring clip, mounted on one of the rail walls, normally urges a pin into the inward end portion of the respective tongue slot when the tongue is in erected stud marking position. Each of the tongues are provided with a central longitudinal extending pencil point receiving slot serving as a pencil guide.

A rafter cut marking member is also pivotally connected at one end portion between the parallel walls which may be indexed to form a desired angular cut marking guide. The rail member is provided with indicia indicating increments of linear measurement and may include spirit levels for leveling and plumbing framing materials.

The principal object of this invention is to provide a wall framing stud and rafter layout tool for marking dimensioned lumber at preselected positions in which the pencil guide tongues are pivotally connected with and foldable into and out of a rail member in a jackknife blade folding action.

DESCRIPTION OF THE PREFERRED EMBODIMENTS

Figures 1, 2, 3, 4, 5, 6, 7:
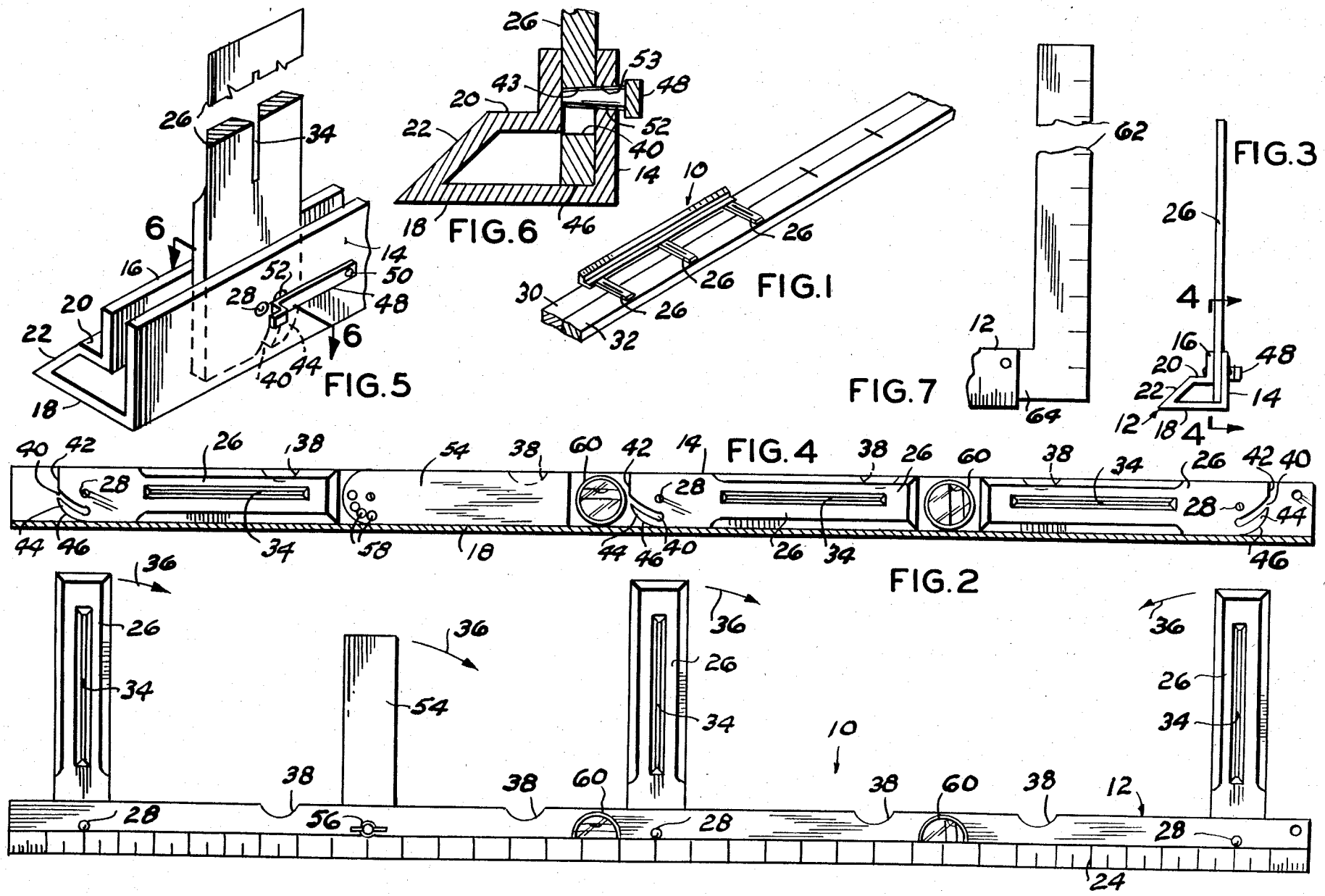
FIG. 1 is a fragmentary perspective view of the device in operative position for marking wall stud positions.
FIG. 2 is an elevational view, to a larger scale, of the tool, per se.
FIG. 3 is a right end elevational view of FIG. 2.
FIG. 4 is a vertical cross sectional view, partially in elevation, taken substantially along the line 4—4 of FIG. 3.
FIG. 5 is a fragmentary perspective view, to a further enlarged scale, of the rearward side of the tool illustrating the manner in which a spring stop anchors the stud marking tongues in operative position.
FIG. 6 is a fragmentary vertical cross section view taken substantially along the line 6—6 of FIG. 5; and, FIG. 7 is a fragmentary elevational view of the right end portion of the tool illustrating a square forming member connected thereto.

Like characters of reference designate like parts in those figures of the drawings in which they occur.

In the drawings:

The reference numeral 10 indicates the tool, as a whole, which is elongated rail-like in general configuration when in folded position. The tool 10 is formed by an elongated rail 12 of predetermined length preferably spanning the spacing between at least three wall stud positions, as presently explained.

The rail 12 is channel-like, in transverse cross section, comprising a pair of parallel spaced-apart leg or walls hereinafter called a back wall 14 and a front wall 16. The back wall 14 is integrally joined, in right angular relation, to a bight portion forming a base wall 18. The transverse dimension of the front wall 16 is less than the back wall 14 and it is similarly integrally joined to a top wall 20 in spaced parallel relation with respect to the base wall 18. The base wall and top wall are joined by an angular wall 22 forming a downward and laterally inclined surface, as viewed in FIGS. 2 and 3. The surface of the angular wall 22 is preferably scored or printed with indicia 24 throughout its length indicating increments of measurement.

A plurality, three in the example shown, of elongated strap-like tongues 26 are pivotally connected at one end portion between the walls 14 and 16 by rivets 28 in predetermined equally spaced relation longitudinally of the rail 12. The length of each tongue 26 is selected to project laterally of the rail 12 perpendicular to the edge surfaces of the walls 14 and 16 a distance sufficient to span at least adjacent portions of juxtaposed dimension lumber to be marked or scored, such as a sole plate 30 and top plate 32 (FIG. 1) having the tool 10 placed thereon. The width of the tongues 26 may be selected, as for example, to equal the thickness dimension of a standard 2×4 so that, if desired, the position of a 2×4 on one of the plates 30 or 32 may be indicated by drawing a line on respective opposing sides of the tongue.

In the preferred embodiment, the tongues 26 are each provided with an elongated relatively narrow central slot 34 disposed at the inward limit of an elongated recess formed in the surface of the respective tongue adjacent the rail front wall 16. The purpose of the slot 34 is to receive the sharpened point of a pencil or other lumber marking instrument (not shown).

Each of the tongues 26 may be pivoted in the direction of the arrows 36 to be substantially completely contained between the rail walls 14 and 16. The free edge surfaces of the walls 14 and 16 are provided with arcuate thumb recesses or notches 38, adjacent the normally outward disposed end of each tongue, to permit gripping an edge portion of the respective tongue and pivoting it to its laterally projecting position.

The pivotally connected end portion of the tongues 26 are each provided with an inwardly extending slot 40 of selected width off-set from center and extending generally longitudinally from its inwardly disposed end 42 and terminating in a part-circular tapered bore 43 a distance from the end 42 substantially equal to the spacing between the rivet 28 and the end 42. The slot 40 defines an integral tongue spring portion 44. The corner portion of the tongue spring portion 44, adjacent the slot 40, is arcuately curved, as at 46, on a radius slightly greater than the spacing between the axis of the rivet 28 and the inner surface of the base wall 18. The arcuate surface 46 of the spring portion 44 thus binds against the inner surface of the base wall 18 when the outward end of the tongue 26 is pivoted toward and away from the rail 12 so that the spring portion 44 thus maintains the tongue 26 collapsed into the rail or erected normal to the longitudinal axis of the rail to insure the tongues are disposed perpendicular to the rail when used for marking studs.

An elongated spring stop 48 is secured at one end portion to the outer surface of the back wall 14, adjacent the position of the respective tongue 26, by a rivet 50. The opposite end portion of the spring stop is provided with a tapered pin 52 extending through a cooperating opening 53 in the back wall 14 in axial alignment with the position of the innermost tapered end portion 43 of the spring forming slot 40 so that the pin 52 may enter the tapered wall slot end 43 when the tongue 26 is disposed with its longitudinal axis normal to the longitudinal axis of the rail 12.

A protractor is formed by a rafter cut marking tongue 54 of strap-like configuration similarly pivotally secured at one end portion, as by a thumb screw 56, between the rail walls 14 and 16 for pivoting movement into and out of the spacing between the walls. The rafter tongue 54 pivotally connected end portion is provided with a part circular row of angularly spaced indexing apertures 58 for similarly receiving one of the spring stop pins 52 and disposing the rafter tongue at a selected angle relative to the rail 12. The rail 12 is further provided with spirit levels 60 disposed between the walls 14 and 16 to utilize the tool as a level.

As illustrated by FIG. 7, an elongated flat bar 62, preferably having measurement indicia thereon, not shown, is provided with a right angular extending portion 64 at one end which is slidably received between one end portion of the rail walls 14 and 16 to form a carpenter's square, in combination with the rail.

Operation

Operation of the device seems obvious from the above description, but briefly stated, the tongues 26, if in folded position, are manually pivoted outwardly from the rail opposite the direction of the arrows 36 in which the spring stop pin 52 snaps into the inward tapered wall end 43 of the slot 40 to maintain the tongues rigidly in place. The entire tool is then disposed on one or more lengths of dimensioned lumber, such as shown by FIG. 1, and stud spacings scribed by marking the studs through the slots 34 with this action repeated throughout the length of the sole and top plates. When not in use for locating stud spacings, the tongues are preferably manually folded into the rail 12 between its walls. This permits the rafter angle cut marking tongue 54 to be used in a conventional manner or when it is also folded into the rail, the rail becomes a convenient carpenter's rule or may be used as a square when the extension 62 is connected therewith.

Obviously the invention is susceptible to changes or alterations without defeating its practicability. Therefore, I do not wish to be confined to the preferred embodiment shown in the drawings and described herein.

I claim:

1. A carpenter's stud framing layout tool, comprising:

an elongated channel-like rail having a planar bight portion and parallel front and back walls and having a top wall spaced from and parallel with the bight portion and joined to the front wall in laterally projecting normal relation for forming a workpiece abutment when the layout tool is disposed on a length of dimension lumber;

a plurality of strap-like tongues each pivotally secured by one end portion between said front and back walls in normally parallel equally spaced relation corresponding to the desired distance between wall framing studs to be erected for pivoting movement of the other end portion of the said tongues about the axis of the pivotal connection from an erected normally right angular position with respect to said front and back walls toward and away from a nested position between said front and back walls; and, means on the pivotally connected end portion of each said tongue for maintaining said tongues normal to the longitudinal axis of the rail or nested between said front and back walls.

2. The layout tool according to claim 1 in which the means includes:

a spring portion having an arcuate surface formed on a radius greater than the spacing between the axis of the pivotal connection of said tongues and the bight portion of said rail for resiliently bearing against said rail bight portion during pivoting movement of the tongues between the erected and folded positions.

3. The layout tool according to claim 1 in which the pivotally connected end portion of each tongue is provided with a longitudinally extending slot and in which the means includes:

a spring stop secured to said rail adjacent the pivotally connected end portion of each tongue; and, a pin on each said spring stop normally biased inwardly for entering said tongue slot when said tongue is normal to the longitudinal axis of said rail.

4. The layout tool according to claim 3 and further including:

protractor means secured to said rail intermediate its ends and between its walls.

5. The layout tool according to claim 4 and further including:

spirit levels mounted on said rail intermediate its ends.

* * * * *